United States Patent [19]

Weiskopf

[11] 3,951,024

[45] Apr. 20, 1976

[54] GANG LOCKING MEANS FOR SLITTER HEADS

[75] Inventor: Gunther Weiskopf, New York, N.Y.

[73] Assignee: S&S Corrugated Paper Machinery Co., Inc., Brooklyn, N.Y.

[22] Filed: Mar. 29, 1974

[21] Appl. No.: 456,012

[52] U.S. Cl. ..... 83/498; 83/501; 83/665; 83/675; 83/700

[51] Int. Cl.[2] ..... B26D 1/24

[58] Field of Search ..... 83/675, 659, 665, 504, 83/502, 498, 499, 699, 700, 501

[56] References Cited

UNITED STATES PATENTS

| | | | |
|---|---|---|---|
| 2,598,820 | 6/1952 | Neese | 83/659 X |
| 2,801,694 | 8/1957 | Schneider et al. | 83/675 |
| 3,073,198 | 1/1963 | Clem | 83/665 X |
| 3,153,967 | 10/1964 | Williams et al. | 83/675 |
| 3,173,325 | 3/1965 | Warren et al. | 83/665 X |
| 3,422,714 | 1/1969 | Gompel et al. | 83/504 X |

*Primary Examiner*—Frank T. Yost
*Attorney, Agent, or Firm*—Ostrolenk, Faber, Gerb & Soffen

[57] ABSTRACT

Slitting apparatus for trimming the edges of a web of corrugated board and longitudinally cutting the web into a plurality of narrow webs is constructed with selectively operable fluid operated means that clamps the working heads in adjusted positions along the length of their respective drive shafts. The fluid operated means includes a plurality of pressure bars extending parallel to the length of each shaft and disposed within different grooves thereof. The pressure bars are constructed of spring steel, and each is operatively positioned to clamp a plurality of heads in operating positions by engaging keys secured to these heads. The keys extend beyond the faces of the heads, and for each of the heads include notches that provide clearance for the extending portions of the keys secured to adjacent heads.

The drive shafts are parallel to each other. One of these shafts is longitudinally movable after the heads are locked in place so that the knives mounted thereon positively mate with or engage cooperating knives on the other shaft.

11 Claims, 8 Drawing Figures

FIG. 1.
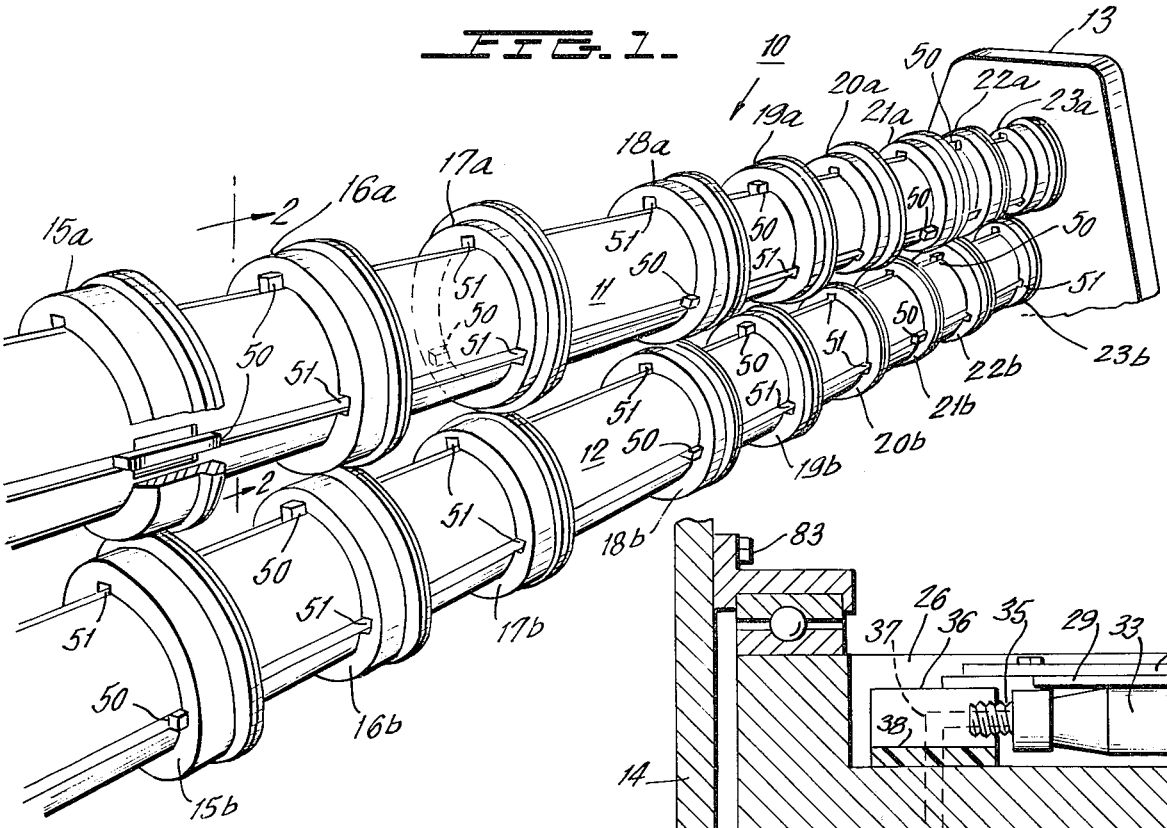
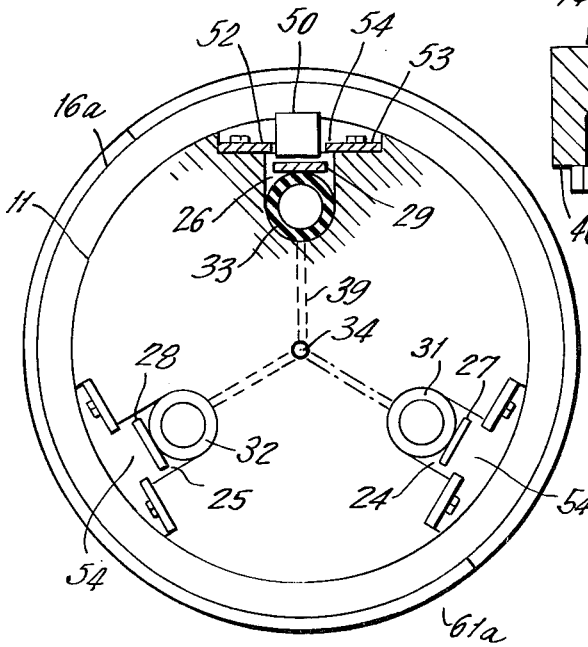
FIG. 2.
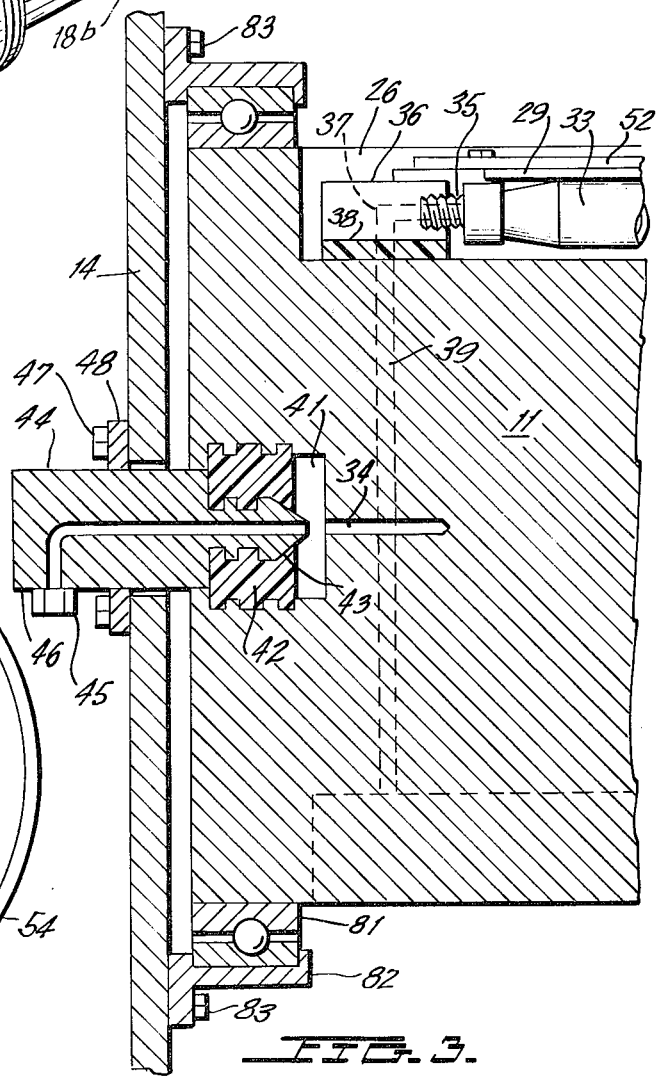
FIG. 3.

GANG LOCKING MEANS FOR SLITTER HEADS

This invention relates to rotary slitting apparatus and more particularly relates to apparatus of this type having selectively operable fluid operating means to lock a plurality of slitter heads in adjusted position on their respective drive shafts.

In the production of double-faced corrugated board, the wide web of corrugated board produced by the double-backer passes through a heating section into a pulling or cooling section, and then passes through slitting apparatus which trims the edges of the wide web. The slitting apparatus comprises a pair of transversely extending drive shafts having sets of slitting heads adjustably mounted thereon. These heads cut the web longitudinally to form a plurality of relatively narrow webs. Very often the apparatus also includes scoring heads which apply longitudinally extending scores to these webs.

In one form of prior art slitter apparatus, repositioning of the heads on their drive shafts requires the operator to unlock the screw clamped heads individually, move each of the heads to its new position, and then individually screw-clamp each head at its new position. In accordance with the instant invention, fluid pressure is utilized to selectively lock and unlock all of the slitter heads simultaneously.

The pneumatic locking means includes a plurality of locking bars each of which is disposed within a longitudinally extending shaft slot and is associated with an inflatable hose. When the hose is subjected to internal pressure, it expands and drives the locking bar into clamping engagement with a plurality of keys each mounted to an individual head. The locking bars are deflectable, so as to engage extensive areas of the keys and to insure that manufacturing tolerances are not able to gang up to defeat the purpose of the locking bar. Further, the deflectable nature of the locking bar enables it to firmly engage three or more keys.

Accordingly, a primary object of the instant invention is to provide novel gang locking means for the working heads of slitting apparatus.

Still another object is to provide rotary slitting means having fluid operating means for gang locking the heads in their operative positions on the support shafts.

Another object is to provide apparatus of this type in which the gang locking means includes flexible locking bars.

Still another object is to provide apparatus of this type in which retaining means for the pressure bar is constructed to provide a guideway wherein keys secured to the working heads are disposed.

A further object is to provide apparatus of this type having means for moving tools on one shaft into operative engagement with tools on the other shaft after the heads are secured in operative positions on these shafts.

These objects as well as other objects of this invention will become readily apparent after reading the following description of the accompanying drawings in which:

FIG. 1 is a fragmentary perspective of rotary slitting apparatus constructed in accordance with teachings of the instant invention.

FIG. 2 is a cross-section taken through line 2—2 of FIG. 1 looking in the direction of arrows 2—2.

FIG. 3 is a fragmentary cross-section through a diameter of one of the slitter shafts at the end thereof having a rotary fluid coupling.

In FIG. 6 the heads are shown immediately after head clamping, and in FIG. 7 the heads are shown in their operating positions.

Figure 6:
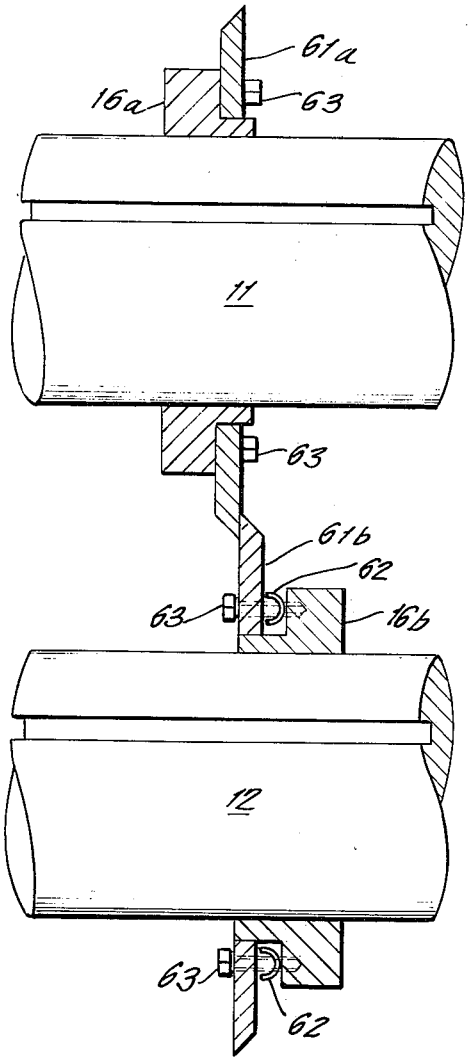
FIGS. 6 and 7 are fragmentary cross-sections illustrating a feature of the instant invention which provides means for operatively engaging cooperating knife blades after their heads are securely clamped to the drive shaft.
Figure 7:
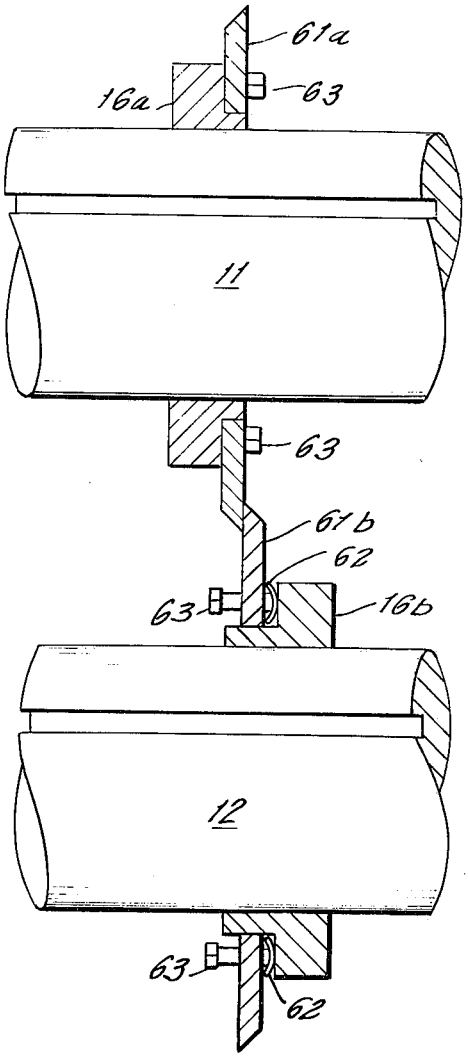

Now referring to the figures. The rotary slitting apparatus indicated generally by reference numeral 10 in FIG. 1 includes parallel upper and lower drive shafts 11, 12 having their ends supported by vertical frame members 13, 14 (FIG. 3). Drive shafts 11, 12 extend transverse to the direction of travel of web material, such as corrugated board, that passes between shafts 11, 12 and is operated upon by the tools mounted on shafts 11, 12. Shaft 11 mounts a plurality of tool supporting heads **15*a*–23*a*, and shaft 12 mounts another plurality of tool carrying heads 15*b*–23*b*. As is well known to the art, the tools on each pair of opposed heads cooperate to either longitudinally slit, score, or slot a web traveling along a feed path in the space between drive shafts 11, 12.**

As seen in FIG. 2, shaft 11 is provided with three longitudinally extending slots 24–26 spaced 120° apart. Pressure bars 27–29 are disposed respectively within slots 24–26. Also disposed within slots 24–26 but positioned inboard of bars 27–29 are the respective inflatable hoses 31–33. For substantially the full length of each of the slots 24–26 and along opposite sides thereof are a pair of strips 52, 53 that partially overlie the entrances to slots 24–26 and serve to retain pressure bar 27–29 within slots 24–26.

All three hoses 31–33 are connected to axially extending passage 34 in shaft 11 by similar elements which will be described only in connection with hose 33.

More particularly, one end of hose 33 is clamped shut and the other end is provided with male coupling 35 threadably mounted to block 36 at one end of L-shaped passage 37 in block 36. The other end of passage 37 communicates with a hole in gasket 38 which is interposed between block 36 and the inboard boundary surface of slot 26, and this way communicates with radially extending passage 39 in shaft 11. Passage 39 communicates with axially extending passage 34. The latter passage 34 communicates with end chamber 41 wherein rotary packing seal 42 is disposed. The latter surrounds the formed end 43 at the right of block 44 with L-shaped passage extending through block 44 from end 43 to coupling 45 secured to block surface 46.

Block 44 extends through an aperture in frame 14 and is secured thereto by bolts 47 extending through collar 48 that is welded to block 44. The end of shaft 11 having chamber 41 is provided with bearing 81 which in turn is mounted to annular bearing support 82 that is secured by bolts 83 to frame member 14.

An individual key 50 is secured to each of the heads **15*a*–23*a* and 15*b*–23*b*. Keys 50 secured to each third head are disposed within slot 26. The confronting edges of strips 52, 53 are spaced apart to form guideway 54 within which keys 50 travel. A different set of keys 50 secured to different heads, also spaced apart by two heads, are entered into slot 25, and keys 50 secured to the remaining heads are entered into slot 24. Notches or cutouts 51 extending through heads 15***a*–23*a*, 15*b*–23*b* from side to side thereof provide clearance recesses to receive the end portions of keys 50 on adjacent heads so that the heads 15*a*–23*a*, 15*b*–23*b* may be moved very close to each other.

It is noted that lower shaft 12 is provided with essentially the same gang locking means for heads 15*b*–23*b* as the gang locking means for heads 15*a*–23*a* mounted on upper shaft 11.

Slitter apparatus 10 is utilized by initially relaxing pressure within hoses 31–33 of both upper and lower drive shafts 11, 12. Heads 15*a*–23*a*, 15*b*–23*b* are moved to selected positions along the lengths of their respective drive shafts 11, 12. High pressure air is then introduced at coupling 45 to inflate all of the hoses 31–33, causing them to expand and drive pressure bar 27–29 into firm engagement with keys 50 to produce clamping forces which prevent movement of heads 15*a*–23*a*, 15*b*–23*b* along shafts 11 and 12.

Figure 4:
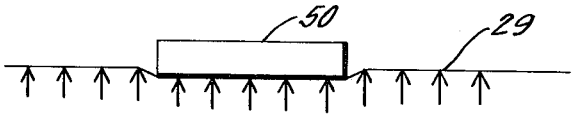
FIGS. 4 and 5 are diagrams used for explanation of operating principles of the instant invention.

Pressure bars 27–29 are constructed of spring steel so that each bar 27–29 is neither completely stiff nor completely flexible. If pressure bars 27–29 were completely flexible, they could not control expandable hoses 31–33 and the force applied to each key 50 would only be a function of the area of a hose 31–33 under the particular key 50. By using a stiff yet flexible pressure bar, hose portions extending in a longitudinal direction with respect to the drive shaft contribute to the clamping force acting on the key 50. That is, the upward force of each hose 31–33, indicated by the upwardly pointing arrows in FIG. 4, is transmitted to some extent to each key 50 through a pressure bar 26–29. The total force applied by the expandable hose to key 50 is also increased by having the length of each key 50 considerably greater than the thickness of each head.

Figure 5:
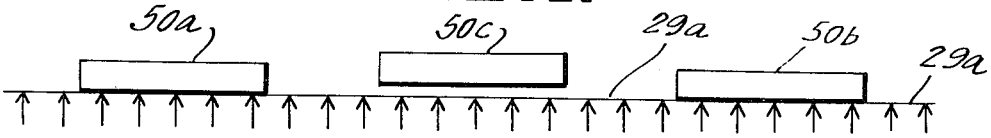

The use of a very rigid pressure bar is undesirable when more than two heads are to be locked by each pressure bar. That is, because of normal manufacturing tolerances, it is possible that with three keys 50 in one slot, the two outer keys 50*a*, 50*b* (FIG. 5) may extend farther into the keyway than the center key 50*c*. If the pressure bar 29*a* were very rigid, all of the locking force would be applied to the outer heads and none of the locking force would be applied to the center head since pressure bar 29*a* would be too rigid to deflect and engage center key 50*c*. However, if pressure bar 29*a* is replaced by bar 29 in FIG. 5, bar 29 will deflect upward between keys 50*a*, 50*b* and engage keys 50*c* so that sufficient clamping forces are applied to all three keys 50*a*, 50*b*, 50*c*.

As seen in FIG. 6, split blades 61*a*, 61*b* secured to heads 16*a*, 16*b*, respectively, cooperate with each other by being in operative engagement. For proper cutting, blade engagement must be under pressure. Thus, a plurality of relatively stiff leaf springs 62 are interposed between blade 61*b* and head 16*b* and are positioned to bias blade 61*b* toward blade 61*a*. All of the other slitter blades on lower shaft 12 are spring mounted in essentially the same manner as blade 61*b*. During the setup of slitter apparatus 10, when fluid pressure is applied to expandable hoses 31–33, heads 16*a*, 16*b* are locked in the positions shown in FIG. 6, so that blade 61*b* rests against the heads of its retaining screws 63. Further loading of spring 62 is accomplished by moving shaft 12 slightly to the left with respect to the position occupied by it in FIG. 6. This moves all of the heads 15*b*–23*b* to the left simultaneously and at the same time increases the spring loading on the slitter blades mounted to each of the heads 16*b*–23*b*. For a construction in which tools are not spring loaded on their respective heads, after cooperating heads are brought into abutment, each of the heads on one drive shaft may be tapped by a manually or automatically operated hammer to move these heads slightly along the axis of their shaft to obtain pressure engagement between cooperating blades 61*a*, 61*b*. Of course, there are some tools, such as creasers, that do not require side loading.

Figure 8:
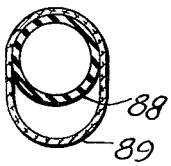
FIG. 8 is a transverse cross-section of hose constructed of a deflated flexible tube disposed within a mesh-like expansion confining sleeve.

Very flexible tube 89 surrounded by expansion limiting fabric-like close-knit mesh flexible sleeve or jacket 88 of FIG. 8 may be used to replace each of the hoses 31–33 which directly engages the respective pressure bars 27–29. This combination of tube 89 and sleeve 88 results in an expandable unit that is strong enough to contain the air pressure required for clamping and is still flexible enough to transmit air pressure throughout the entire length of each pressure bar 27–29.

Although in the foregoing there have been described preferred embodiments of this novel invention, many variations and modifications will now be apparent to those skilled in the art, and it is preferred therefore that the instant invention be limited not by the disclosure contained herein but only by the appending claims.

I claim:

1. Apparatus for longitudinally slitting a web traveling along a feed path, said apparatus including a drive shaft extending transverse to said path, a plurality of tool supporting heads mounted on said shaft to be rotated thereby, each of said heads having an individual means movable therewith longitudinally along said shaft and projecting into a longitudinally extending slot means in said shaft, and locking means for maintaining said heads in adjusted positions along the length of said shaft; said locking means including a pressure bar mounted within said slot means and selectively actuable fluid operated means within said slot means which when actuated drives said pressure bar into operative locking engagement with said individual means of at least a first and second of said plurality of heads.

2. Apparatus as set forth in claim 1 in which the pressure bar is constructed of material having deflecting properties similar to those of a spring steel.

3. Apparatus as set forth in claim 2 in which the fluid operated means includes an inflatable hose-like member.

4. Apparatus as set forth in claim 3 also including retaining means capturing said pressure bar and said hose-like member within said slot.

5. Apparatus as set forth in claim 4 in which the individual means comprise first and second keys secured to the respective first and second heads; said keys extending into said slot means; said retaining means also constructed to function as a guide means for said keys as the heads are adjusted along said shaft.

6. Apparatus as set forth in claim 1 in which said locking means also includes another pressure bar mounted within another longitudinally extending slot means in said shaft angularly offset from said slot means, and another selectively actuable fluid operated means within said another slot means which when actuated drives said another pressure bar into operative locking engagement with the individual means of at least a third and fourth of said plurality of heads.

7. Apparatus as set forth in claim 6 in which the third head is between the first and second heads, and the second head is between the third and fourth heads.

8. Apparatus as set forth in claim 1 in which the fluid operated means includes an inflatable tube and a flexible sleeve wherein said tube is disposed, said sleeve being constructed to limit expansion of said tube.

9. Apparatus for longitudinally slitting a web traveling along a feed path, said apparatus including a drive shaft extending transverse to said path, a plurality of tool supporting heads mounted on said shaft to be rotated thereby, and locking means for maintaining said heads in adjusted positions along the length of said shaft; said locking means including a pressure bar mounted within a longitudinally extending slot means and selectively actuable fluid operated means within said slot means which when actuated drives said pressure bar into operative locking engagement with at least a first and second of said plurality of heads; said locking means also including another pressure bar mounted within another longitudinally extending slot means in said shaft angularly offset from said slot means, and another selectively actuable fluid operated means within said another slot means which when actuated drives said another pressure bar into operative locking engagement with at least a third and fourth of said plurality of heads; said third head positioned between said first and second heads, and said second head positioned between said third and fourth heads.

10. Apparatus as set forth in claim 9 in which there are first and second keys secured to the respective first and second heads, extending into said slot means and interposed between said pressure bar and said first and second heads; third and fourth keys secured to the respective third and fourth heads, extending into said another slot means and interposed between said another pressure bar and said third and fourth heads.

11. Apparatus as set forth in claim 10 in which each of siad keys extends axially beyond both sides of the head to which it is secured; said third and fourth head having recesses operatively positioned to receive projecting portions of the respective first and second keys.

* * * * *